US006287036B1

(12) United States Patent
Keda et al.

(10) Patent No.: US 6,287,036 B1
(45) Date of Patent: Sep. 11, 2001

(54) KNOCKING WRITING UTENSIL

(75) Inventors: Tadashi Keda; Yoshihide Mitsuya, both of Kawagoe (JP)

(73) Assignee: Kotobuki & Co., Ltd., Kyoto (JP)

( * ) Notice: Subject to any disclaimer, the term of this patent is extended or adjusted under 35 U.S.C. 154(b) by 0 days.

(21) Appl. No.: 09/590,697

(22) Filed: Jun. 9, 2000

(30) Foreign Application Priority Data

Feb. 10, 2000 (JP) ..... 12-034050

(51) Int. Cl.[7] ..... B43K 5/12

(52) U.S. Cl. ..... 401/194; 401/195; 401/104; 401/110

(58) Field of Search ..... 401/104, 194, 401/192, 99, 110, 111, 112, 195, 32

(56) References Cited

U.S. PATENT DOCUMENTS 1,806,580 * 5/1931 Barth ..... 401/194
2,339,514 * 1/1944 Ponath ..... 401/194
2,751,700 * 6/1956 Danjczek ..... 401/194

FOREIGN PATENT DOCUMENTS 2 563 645 * 10/1985 (FR) ..... 401/195

* cited by examiner

*Primary Examiner*—David J. Walczak
(74) *Attorney, Agent, or Firm*—McGinn & Gibb, PLLC

(57) ABSTRACT

A knocking writing utensil for use with a writing medium includes an external cylinder for receiving the writing medium located inside the external cylinder, the medium being urged rearwardly, a rotational cam mechanism including a cam cylinder capable of rotating and moving rearwardly and forwardly inside the external cylinder and regulating rearwardly movement of the writing medium, a cam body for rotating the cam cylinder at a predetermined angle each time the cam cylinder is propelled forwardly so that the cam cylinder moves alternately to a forward position and a withdrawal position, and a cam bar capable of pushing the cam cylinder forward. A knock body is connected with the cam bar so that a knock operation is feasible, the knock body undergoing a knock operation so that the cam cylinder rotates as well as moves rearwardly and forwardly in the axial direction to drive the writing medium. A window, from which an interior of said external cylinder is visible, is provided at a portion of a circumferential surface of the external cylinder. A rotational drum, rotating in an interlocking fashion with rotation of the cam cylinder and including indications on an outer circumferential surface thereof, is located inside the external cylinder so that the indications are visible from the window.

27 Claims, 8 Drawing Sheets

KNOCKING WRITING UTENSIL

BACKGROUND OF THE INVENTION

1. Field of the Invention

The present invention generally relates to a knocking writing utensil, and in particular to a knocking writing utensil for which pictorial indications such as letters, patterns, etc. are provided.

2. Description of the Related Art

A conventional knocking writing utensil is commonly provided with printed letters and patterns on the surface of its external cylinder. However, such a conventional knocking writing utensil does not provide any variation on its printed indications, and therefore hardly catches a user's attention.

SUMMARY OF THE INVENTION

In view of the foregoing and other problems, disadvantages, and drawbacks of the conventional writing utensil, the present invention has been devised, and it is an object of the present invention to provide a knocking writing utensil capable of varying its indications.

To attain the above and other objects, a knocking writing utensil according to the present invention includes an external cylinder, a writing medium located inside the external cylinder and urged rearwardly, and a rotational cam mechanism. The rotational cam mechanism includes a cam cylinder capable of rotating and moving backward and forwardly inside the external cylinder and regulating rearwardly movement of the writing medium, a cam body rotating the cam cylinder at a predetermined angle each time the cam cylinder is propelled forwardly so that the cam cylinder moves alternately to a forward position and a withdrawal position, and a cam bar capable of pushing the earn cylinder forwardly.

Preferably, a knock body is integrally formed with the cam bar, or is connected to the cam bar, so that a knock operation is feasible. The knock body undergoes a knock operation so that the cam cylinder rotates, as well as moves rearwardly and forwardly, in the axial direction, and makes a tip of the writing medium be projected out of and retracted into a tip of the external cylinder. A window, from which the inside of the external cylinder is visible, is provided at a portion of a circumferential surface of the external cylinder.

Preferably, a rotational drum having indications (e.g., indicia) of letters, illustrations, etc. provided on an outer circumferential surface thereof is located inside the external cylinder to rotate in an interlocking fashion with the rotation of the above-described cam cylinder so that the indications are visible through the window. When the knock body undergoes a knocking operation so that the cam bar is propelled forwardly in an integral fashion with the knock body, the cam bar pushes the cam cylinder forwardly and the cam cylinder rotates at a predetermined angle while it is propelled forwardly. The cam cylinder moves to a forward position and to a withdrawal position alternately each time it rotates at the predetermined angle so as to drive the writing medium. In addition, the rotational drum rotates in an interlocking fashion with the rotation of the earn cylinder so that indications of letters, illustrations, etc. provided on the outer circumferential surface of the rotational drum and externally visible through the window are changed so as to better attract a user's interest.

Further, the rotational drum may be connected to the cam cylinder so as to be movable in the axial direction and non-rotatable relative to the cam cylinder, and is located so as to be incapable of moving in the axial direction relative to the external cylinder. While the cam cylinder moves rearwardly and forwardly relative to the external cylinder as well as rotates, the rotational drum is incapable of moving in the axial direction relative to the external cylinder, and thus, only rotation of the cam cylinder is transmitted to the rotational drum.

Regardless of the rearwardly and forwardly movement of the cam cylinder, the rotational drum does not move in the axial direction. As a result, the rotational drum moves in the circumferential direction in unison with the rotation of the cam cylinder. Thus, the rotational drum having the indications provided on the outer circumferential surface thereof is incapable of moving in the axial direction, so that changing of the indications by the rotation of the rotational drum can be carried out smoothly and neatly. In addition, the rotational drum does not move rearwardly and forwardly and as a result the window can be widely used and it is possible to take a wide area of the outer circumferential surface of the rotational drum for the indications.

Still further, the cam cylinder and rotational drum preferably are connected by a polygonally-shaped bore formed in either member being fitted into a polygonal-shaped external cylinder surface formed in the other member. Thus, both members can easily be connected.

A knock writing utensil according to another aspect of the invention includes an external cylinder, a writing medium located inside the external cylinder and urged rearwardly, and a rotational cam mechanism. The rotational cam mechanism includes a cam cylinder provided so as to be incapable of rotating but capable of moving rearwardly and forwardly inside the external cylinder and regulating rearwardly movement of the writing medium, a cam body, which is located inside the external cylinder so as to be incapable of moving rearwardly and forwardly, rotating at a predetermined angle each time the cam cylinder is propelled forwardly so that the cam cylinder moves alternately to a forward position and a withdrawal position, and a cam bar capable of pushing the cam cylinder forwardly.

A knock body is integrally formed with the cam bar or is connected to the cam bar so that a knock operation is feasible. The knock body undergoes a knock operation so that the cam body rotates while the cam cylinder moves rearwardly and forwardly in the axial direction so as to drive the writing medium. A window, from which the inside of the external cylinder is visible, is provided at a portion of a circumferential surface of the external cylinder. A rotational drum having indications of letters, illustrations, etc. provided on an outer circumferential surface thereof is located inside the external cylinder to rotate in an interlocking fashion with a rotation of the cam body so that the indications are visible through the window.

When the knock body undergoes a knocking operation, the cam bar is propelled forwardly integrally with the knock body. At this time, the cam bar pushes the cam cylinder forwardly and the cam body rotates at the predetermined angle as the cam bar goes forwardly. The cam cylinder moves to a forward position and to a withdrawal position alternately each time the cam body rotates at the predetermined angle, whereby the writing medium is driven. In addition, the rotational drum rotates in an interlocking fashion with the rotation of the cam body so that indications of letters, illustrations, etc. provided on the outer circumferential surface of the rotational drum and visible externally through the window are changed to appear more interesting.

Preferably, the rotational drum is formed integrally with the cam body. Thus, the number of components can be reduced. As the cam body does not move rearwardly and forwardly, the rotational drum moves in a circumferential direction together with the rotation of the cam body, and thus no axial movement occurs in the rotational drum. Thus, the rotational drum having the indications provided on the outer circumferential surface thereof is incapable of moving in the axial direction, so that changing of the indications by the rotation of the rotational drum can be carried out smoothly and neatly.

While the window may be simply a through-hole, it can alternatively be a transparent body provided internally which acts as a magnifying lens. In such a case, since the transparent body for the window is a lens, the letters or illustrations provided on the rotational drum are magnified, thus drawing a user's attention more easily. In addition, the transparent body can prevent dust, trash, and the like from penetrating the writing utensil through the window.

Alternatively, a transparent body can be provided inside the window so that the transparent body, and at least a portion of the external cylinder, are integrally molded by a dichroic molding technique or an insert molding technique. The window and the external cylinder provided integrally by dichroic molding or insert molding are easily molded. In addition, the transparent body, as above, can prevent dust, trash, and the like from intruding into the writing utensil through the window.

Alternatively, at least a portion, including the window of the external cylinder, can be molded with a transparent resin, and color printing can be applied onto at least a portion of the external cylinder surrounding the window. Alternatively, a transparent body can be fitted inside the window which can be easily formed in the external cylinder. Additionally, the transparent resin or the transparent body prevents dust, trash, and the like from intruding into the writing utensil through the window.

The present disclosure relates to subject matter contained in Japanese Patent Application No. Hei. 2000-34050, filed Feb. 10, 2000, which is expressly incorporated herein by reference in its entirety.

BRIEF DESCRIPTION OF THE DRAWINGS

The foregoing and other objects, aspects and advantages will be better understood from the following detailed description of preferred embodiments of the invention with reference to the drawings, in which.

DETAILED DESCRIPTION OF PREFERRED EMBODIMENTS OF THE INVENTION

Figure 1:
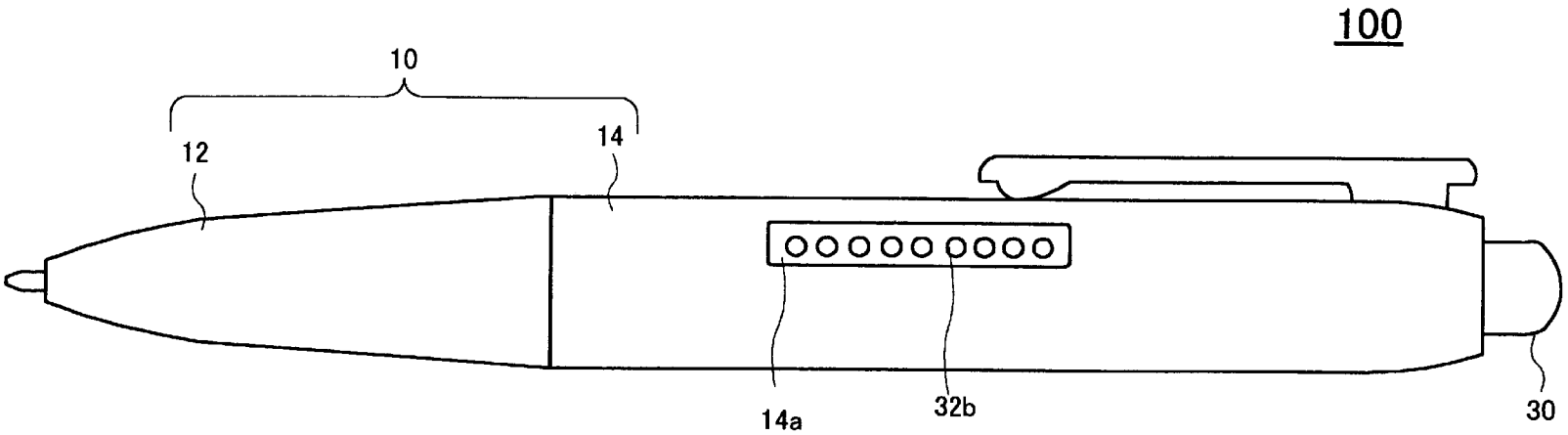
FIG. 1 is a general view showing a first embodiment of a knocking writing utensil according to the present invention.

Referring now to the drawings, and more particularly to FIGS. 1–8, there are shown preferred embodiments of the structures according to the present invention.

FIRST EMBODIMENT

Figure 2:
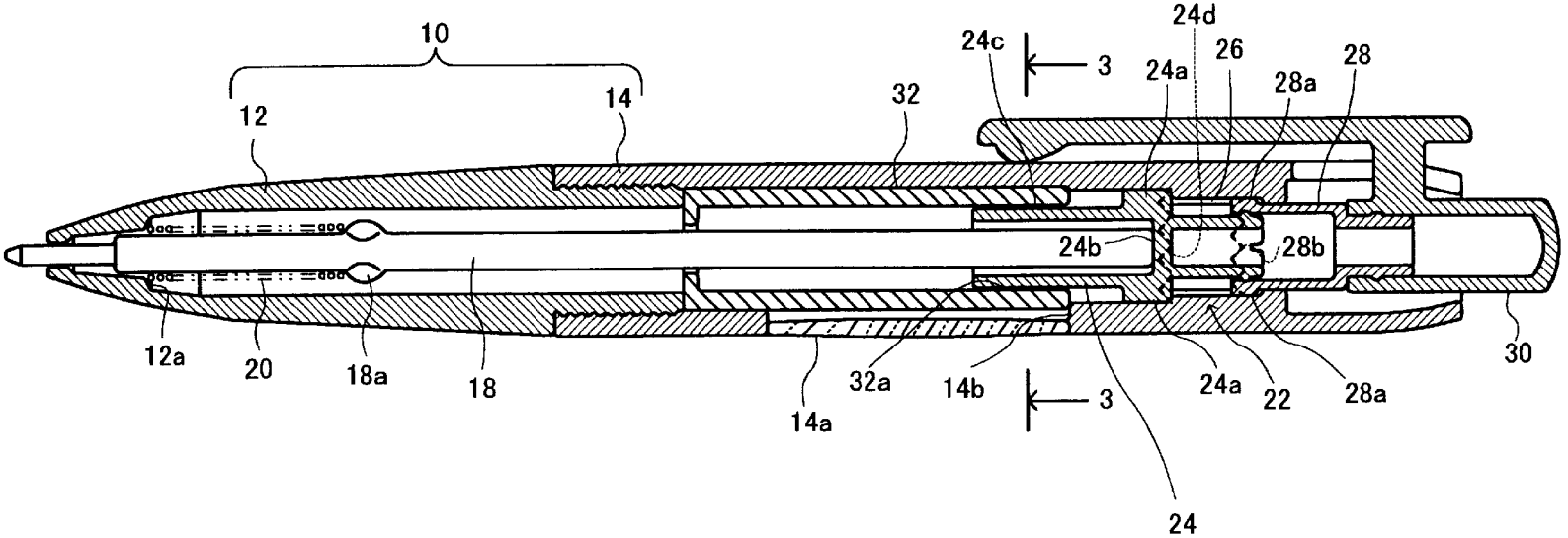
FIG. 2 is a vertical sectional view of the first embodiment of the knocking writing utensil shown in FIG. 1.

Referring to FIGS. 1–5, a first embodiment of the present invention will be described below. In this first embodiment, a ballpoint pen is exemplified as a knocking writing utensil 100, with FIG. 1 showing a general view and FIG. 2 showing a vertical sectional view. Other types of knock writing utensils could also be employed, as would be evident to one of ordinary skill in the art, taking the present application as a whole.

A knock writing utensil with an external cylinder 10 includes a front cylinder 12 and a rear cylinder 14 fixed to (e.g., screwed into) the front cylinder 12.

A refill (e.g., a writing medium) 18 is located inside the external cylinder 10. The refill 18 is constantly urged rearwardly by a return spring 20 interposed between a spring receiving portion 11*a* of the refill 18 and an internal step portion 12*a* of the front cylinder 12.

A rotational cam mechanism 22 is located in the rear internal portion of the external cylinder 10. The rotational cam mechanism 22 includes a cam cylinder 24 capable of rotating and moving rearwardly and forwardly inside the external cylinder 10, a cam body 26 for regulating the position of the cam cylinder 24, and a cam bar 28 capable of pushing the cam cylinder 24 forwardly.

Figure 4:
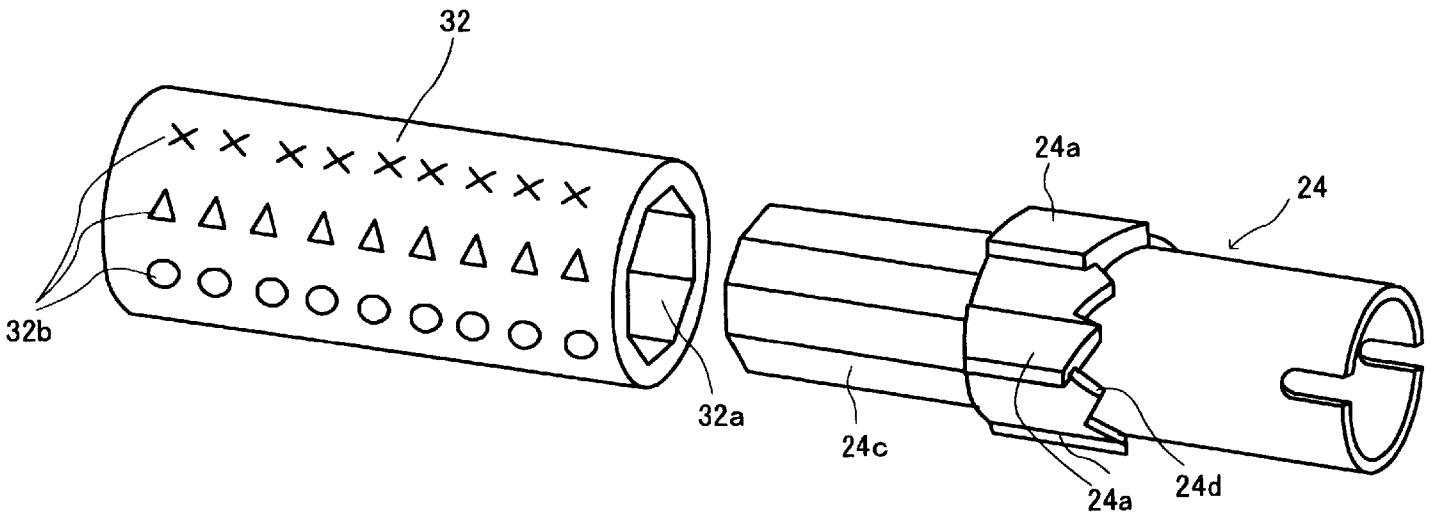
FIG. 4 is a magnified perspective view of a cam cylinder and a rotational drum according to the first embodiment of the present invention.

A rear end of the refill 18 is inserted inside the cam cylinder 24, and the rear end of the refill 18 comes into contact with a partition wall 24*b* inside the cam cylinder 24 so as to regulate rearwardly movement of the refill 18. In addition, as shown in FIG. 4, on the outer circumferential surface of the cam cylinder 24, protrusions 24a are formed to engagingly-lock on the cam surfaces 26*a* of the cam body 26 (e.g., described below). On the circumferential surface of the cam cylinder 24, a plurality of saw teeth 24*d* are formed.

Figure 5:
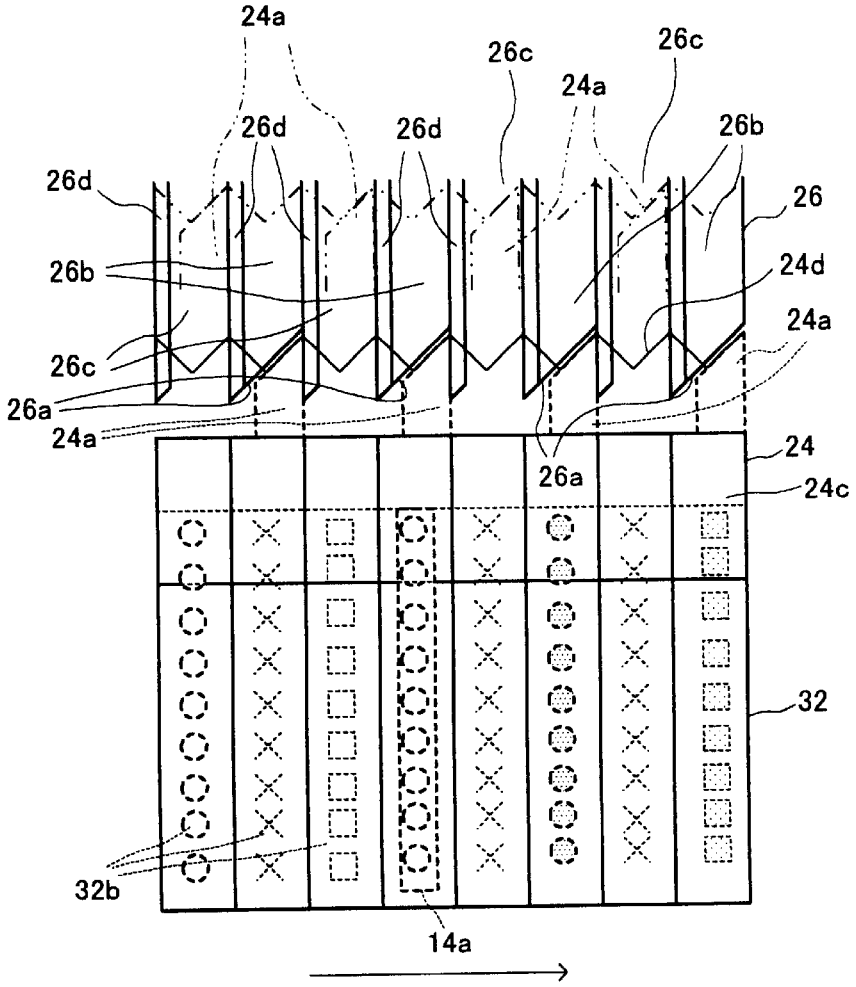
FIG. 5 is an unfolded view showing a cam body, a cam cylinder, and a rotational drum.

As shown in FIG. 5, the cam body 26, which is integrally formed with the rear cylinder 14 (but, of course, may be another member different from the rear cylinder 14), is formed by shallow grooves 26*b*, deep grooves 26*c*, and crests 26*d*, the shallow grooves 26*b* and the deep grooves 26*c* being alternately arranged via the crests 26*d* in the circumferential direction of the inner circumferential surface thereof. The saw-tooth-shaped cam surface 26*a* is formed at a front tip of each shallow groove 26*b*, and this cam surface 26*a* engagingly locks the protrusion 24*a* of the cam cylinder 24 while the protrusion 24*a* is capable of entering the deep grooves 26*c*. The cam cylinder 24 is maintained in a forward position such that the protrusions 24*a* engagingly-lock onto the cam surfaces 26*a*, and the cam cylinder 24 is maintained in a rearwardly position such that each deep groove 26*c* receives each protrusion 24*a*.

In addition, as shown in FIG. 2, on an external surface of the cam bar 28, are formed protrusions 28*a*, which are slidable in the shallow grooves 26*b* as well as in the deep grooves 26*c* of the cam body 26. Saw-teeth 28*b*, capable of pushing the cam cylinder 24 forward, are formed at the front tip of the cam bar 28. In addition, a knock body 30 is connected to a rear end of the cam bar 28. Alternatively, the knock body 30 can be integrally formed with the cam bar 28.

The cam cylinder 24 is connected to a rotational drum 32 located in front of the cam cylinder 24 inside the external cylinder 10 and is prevented from rotating relative to the rotational drum 32.

As shown in FIG. 4, the front portion of the cam cylinder 24 undergoes a reduction in diameter and is shaped to have a polygonal outer surface 24*c*. The front portion of the cam cylinder 24 which has the polygonal outer surface 24*c* is inserted into polygonal-shaped holes 32*a* formed in the rear end portion of the rotational drum 32 such that the rotational drum 32 integrally rotates in an interlocking fashion with the rotation of the cam cylinder 24.

Alternatively, an engagement of polygonal-shaped outer surfaces and polygonal-shaped holes preventing the rotation drum 32 from rotating relative to the cam cylinder 24, keys on either surface of the rotational drum 32 or the cam cylinder 24, and key-grooves engaged with the keys located on the other opposite surface can be used to prevent drum 32 and cylinder 24 from rotating relative to each other. The rotational drum 32, the front end of which is abutted against the rear end of the front cylinder 12 and the rear end of which is abutted against the step portion 14*b* of the rear cylinder 14, is capable of rotating inside the external cylinder 10 but is incapable of moving in the axial direction.

Printed letters or illustrations are provided on the outer surface of the rotational drum 32. Indications 32*b* of letters or illustrations on the rotational drum 32 may be provided separately in a circumferential direction corresponding to the rotation pitch of the cam cylinder 24, or they can be provided continuously along the circumferential direction.

Figure 3:
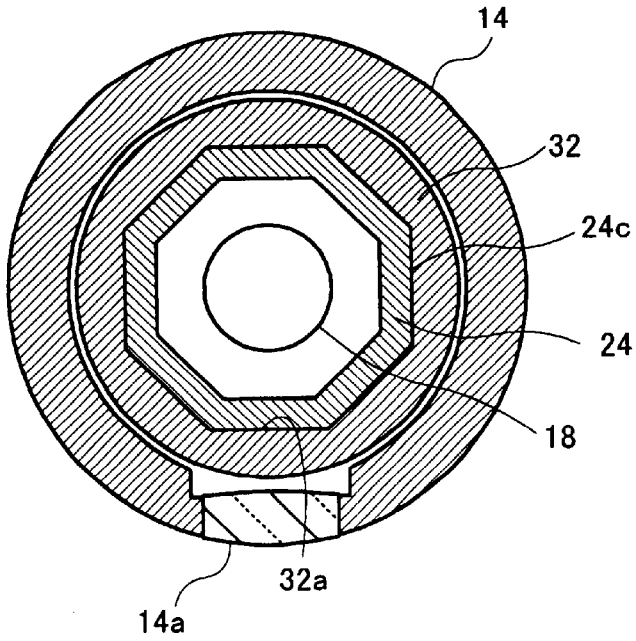
FIG. 3 shows a sectional view of the knocking writing utensil according to the first embodiment taken along a line 3—3 in FIG. 2.

As shown in FIGS. 1–3, a portion of the circumferential surface of the rear cylinder 14 corresponding to the position in an axial direction of the rotational drum 32 has a window 14*a*. Preferably, a transparent body formed by a transparent resin is provided inside the window 14*a*, having a magnifying effect with varied inner thickness of the transparent body.

The operation of a knocking writing utensil according to the first embodiment and configured in this manner will now be described. In this aspect of the present invention, the tip of the refill 18 is retracted inside the external cylinder 10. While the tip of the refill 18 is retracted, the protrusions 24*a* of the cam cylinder 24 are inside the deep grooves 26*c* of the cam body 26 so that the cam cylinder 24 is maintained at the withdrawal position (e.g., the imaginary line position in FIG. 5). When a user wants to write, the knock body 30 is knocked and the cam rotation mechanism 22 starts operating. The knock bar 28 integrally operating with the knock body 30 is propelled forwardly and further propels the cam cylinder 24 forwardly. Then, when the knocking force on the knock body 30 is released, the protrusions 24*a* of the cam cylinder 24 are led by the saw-tooth-shaped cam surfaces 26*a* of the cam body 26 and are engagingly locked on the cam surface 26*a* (e.g., the dotted line position in FIG. 5).

Thus, the cam cylinder 24 is held in the forward position. At this time, since the rotational drum 32 rotates with the rotation of the cam cylinder 24 (e.g., in the direction indicated by the arrow in FIG. 5), indications 32*b* such as letters, illustrations, and the like visible through the window 14*a* of the rear cylinder 14 are changed.

In addition, when the knock body 30 is further knocked, the cam rotational mechanism 22 starts operating so that the knock bar 28 integrally operating with the knock body 30 is propelled forwardly and moves the cam cylinder 24 forwardly. Then, when the knocking force on the knock body 30 is released, the cam cylinder 24 is led again toward deep grooves 26*c* of the cam body 26 so as to return to the withdrawal position.

Since the rotation drum 32 rotates in an interlocking fashion with the rotation of the cam cylinder 24, indications 32*b* of letters, illustrations, and the like visible through the window 14*a* of the rear cylinder 14 change.

Thus, each time the knock body 30 is knocked, indications 32*b* such as letters, illustrations, etc. visible through the window 14*a* of the rear cylinder 14 are varied so as to more effectively draw a user's attention without unduly fatiguing the user.

The rotational drum 32 can be integrally connected to, or be integrally formed with, the cam cylinder 24. In this embodiment, however, the rotational drum 32 cannot move in the axial direction relative to the external cylinder 10. and the cam cylinder 24 cannot rotate but can only move in the axial direction relative to the rotational drum 32. Thus, the rotational drum 32 moves only in the circumferential direction without moving rearwardly and forwardly, so that the indications 32*b* are changed. Thus, changing of the indications 32*b* as seen through the window 14*a* is effected smoothly and neatly. Moreover, since the rotational drum 32 does not move rearwardly and forwardly, a region for placement of the indications 32*b* such as letters, illustrations, etc. covers a large range in the axial direction of the rotational drum 32, and the window 14*a* can be made proportionally larger.

In addition, regarding the rotational drum 32 and the cam cylinder 24, since the polygonal-shaped members are brought into engagement with each other, the drum 32/cylinder 34 can easily undergo matching in their axial directions during an assembly operation, and thus can be easily assembled.

SECOND EMBODIMENT

Figure 6:
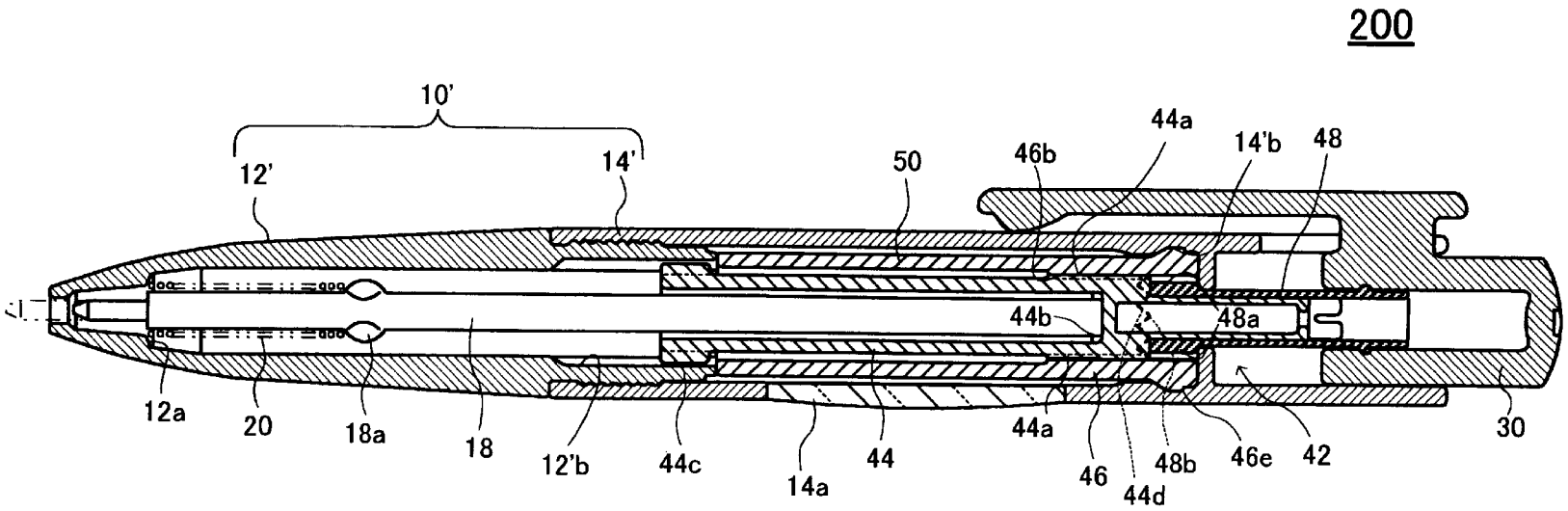
FIG. 6 is a general vertical sectional view showing a second embodiment of the knocking writing utensil according to the present invention.
Figure 7:
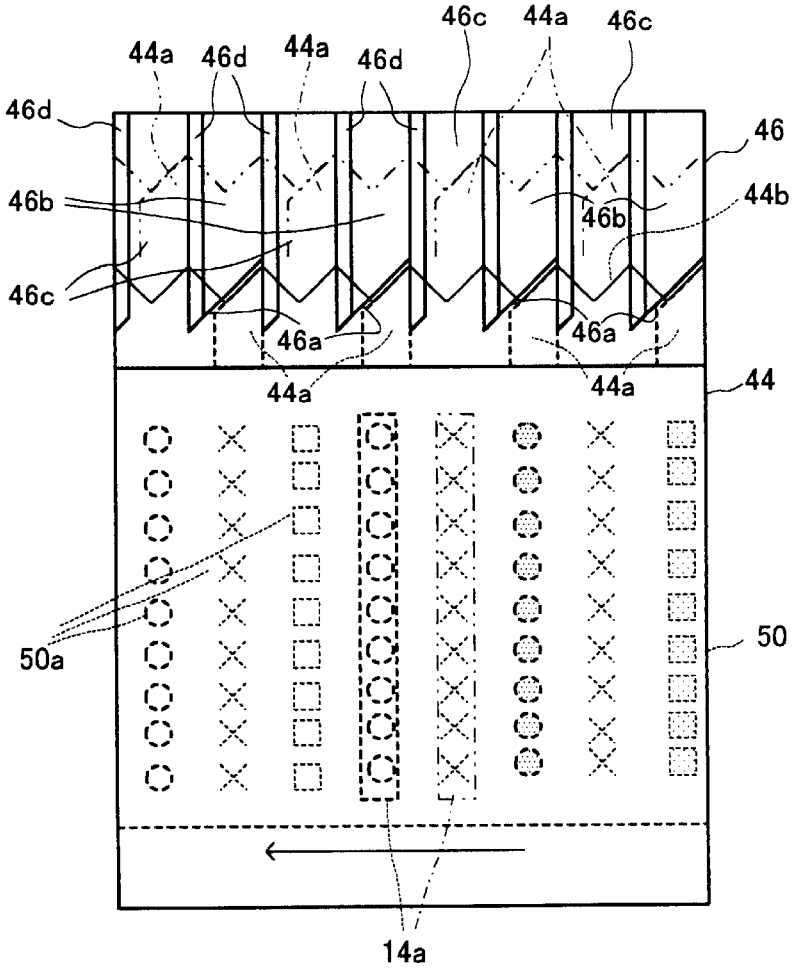
FIG. 7 is an unfolded view showing a cam body, a cam cylinder, and a rotational drum according to the second embodiment.

Referring to FIGS. 6 and 7, a second embodiment of a knock writing utensil according to the present invention will be described below.

In the figures relating to the second embodiment, the same members are denoted by the same reference numbers as in the first embodiment described above, and therefore a detailed description thereon will be omitted.

An external cylinder 10' includes a front cylinder 12' and a rear cylinder 14' screwed into the front cylinder 12'. A rotational cam mechanism 42 different from that in the first embodiment is formed by a cam cylinder 44 incapable of rotating but capable of moving rearwardly and forwardly inside the external cylinder 10', a cam body 46 regulating positions of the cam cylinder 44, and a cam bar 48 capable of pushing the cam cylinder 44 forwardly.

A rear end of the refill 18 is inserted into the cam cylinder 44, and the rear end of the refill 18 comes into contact with a partition wall 44*b* inside the cam cylinder 44. Partition wall 44*b* regulates rearwardly movement of the refill 18.

On the outer circumferential surfaces of the cam cylinder 44, protrusions 44*a* are formed which engagingly-lock on the cam surface 46*a* of the cam body 46 (e.g., described below). On the circumferential surface of the cam cylinder 44, a plurality of saw teeth 44*d* are formed.

In addition, longitudinal ribs 44*c* are formed on the front portion of the cam cylinder 44 to engage with grooves 12'*b* formed in the rear inner surface of the front cylinder 12'. Thus, the cam cylinder 44 cannot rotate inside the external cylinder.

The cam body 46 includes an annular protrusion 46*e* fitted into an annular recess 14*b* of the rear cylinder 14', so that the cam body 46 rotates but does not move in the axial direction relative to the rear cylinder 14'.

Further, as shown in FIG. 7, the cam body 46 includes shallow grooves 46*b*, deep grooves 46*c*, and crests 46*d*. The shallow grooves 46*b* and the deep grooves 46*c* are alternately arranged via the crests 46*d* in the circumferential direction of the inner circumferential surface of the corn body 46. At a front tip of the shallow grooves 46*b*, the saw-shaped cam surfaces 46*a* are formed. The cam surfaces 46*a* engagingly lock the protrusions 44*a* of the cam cylinder 44 while the protrusions 44*a* are capable of entering the deep grooves 46*c*. The cam cylinder 44 is maintained in a forward position such that the protrusions 44*a* engagingly-lock onto the cam surface 46*a*. The cam cylinder 44 is maintained in a withdrawal position such that the deep grooves 46*c* receive the protrusions 44*a*.

In addition, the cam bar 48 is capable of rotating and moving in the axial direction relative to the rear cylinder 14'. On an external surface of the cam bar 48, a plurality of protrusions 48*a* are formed, which are slidable in the shallow grooves 46*b* and in the deep grooves 46*c* of the cam body 26. At the tip of the cam bar 48, saw-teeth 48*b* capable of pushing the cam cylinder 44 forwardly are formed. In addition, a knock body 30 connects to a rear end of the cam bar 48 so as to be able to rotate.

The cam body 46 has a front portion integral with the rotational drum 50, and on the outer surface of the rotational drum 50, printed indications 50*a* such as letters, illustrations, etc. are provided.

The operation of a knocking writing utensil according to the second embodiment of the present invention and configured in this manner will now be described. When the writing instrument is not in use, the tip of the refill 18 is retracted inside the external cylinder 10'. At this time, in the cam cylinder 44, the protrusions 44*a* of the cam cylinder 44 are inside deep grooves 46*c* of the cam body 46 so that the cam cylinder 44 is maintained at the withdrawal position (e.g., the position indicated by the imaginary line in FIG. 7).

When a user intends to write using the writing utensil and knocks the knock body 30, the cam rotation mechanism 42 starts operating and the knock bar 48 is propelled forwardly in turn propelling the cam cylinder 44 forwardly. When the user stops applying the knocking force on the knock body 30, the protrusions 44*a* of the cam cylinder 44 are led by the saw-shaped cam surfaces 46*a* of the cam body 46 causing the cam body 46, as well as the cam bar 48 to rotate, and engagingly lock on the cam surface 46*a* of the cam body 46 (e.g., the position indicated by the dotted line in FIG. 7). In this manner, the cam cylinder 44 is held in the forward position. At this time, since the rotational drum 50 rotates with the rotation of the cam body 46, indications 50*a* such as letters, illustrations, etc. visible through the window 14*a* of the rear cylinder 14' are changed.

Additionally, when the knock body 30 is further knocked, the cam rotational mechanism 42 starts operating so that the knock bar 48 integrally operating with the knock body 30 is propelled forwardly moving the cam cylinder 44 forwardly. Then, when the knocking force on the knock body 30 is released the cam cylinder 44 causes the cam body 46 to rotate and the protrusions 44*a* of the cam cylinder 44 again enter the deep grooves 46*c* of the cam body 46 to thereby return the cam cylinder 44 to the withdrawal position. Further, since the rotational drum 50 rotates together with the rotation of the cam body 46, indications 50*a* of letters, illustrations, etc. visible through the window 14*a* of the rear cylinder 14' change.

Thus, each time the knock body 30 is knocked, letters, illustrations, etc. visible through the window 14*a* of the rear cylinder 14' are varied so as to more easily catch a user's attention without unduly fatiguing the user.

The rotational drum 50 may be formed as a member separate from the cam body 46. In this case. the rotational drum 50 is coupled to the cam body 46 in a manner to be incapable of rotating relative to the corn body 46. The rotational drum 50 can also be integrally formed with the cam body 46, thereby reducing the number of components. In addition, since the cam body 46 does not move rearwardly and forwardly, as in the first embodiment, the rotational drum 50 moves only in the circumferential direction without moving rearwardly and forwardly so that the indications 50*a* are switched. Thus, switching of the indications 50*a* visible through the window 14*a* is effected smoothly and neatly. Moreover, since the rotational drum 50 does not move rearwardly and forwardly, a region for the indications 50*a* such as letters, illustrations, etc. covers a large range in the axial direction of the rotational drum 50, and the window 14*a* can be made proportionally larger.

In addition, any suitable transparent body exhibiting a magnifying effect may be provided inside the window 14*a* so that indications 32*b* and 50*a* on the rotational drums 32 and 50 are enlarged, thereby catching a user's interest more readily.

The transparent body inside the window 14*a* together with portions other than the window 14*a* of the rear cylinders 14 and 14' can be integrally molded by dichroic molding or insert molding techniques.

Figure 8:
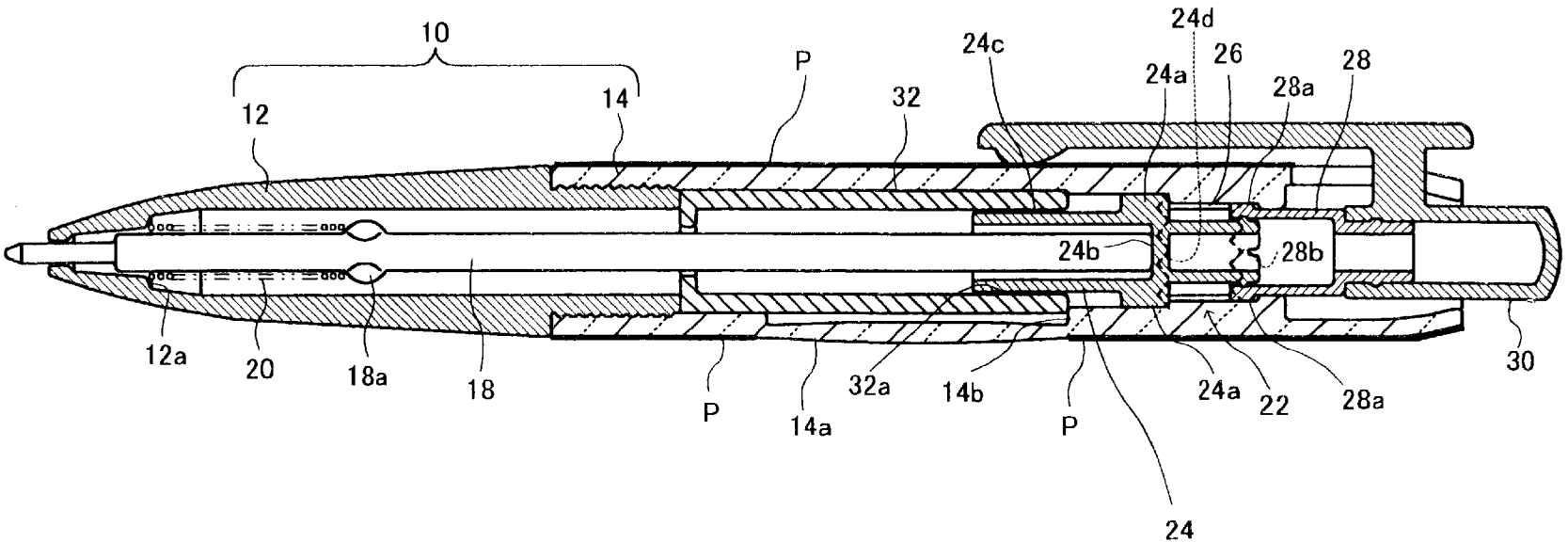
FIG. 8 is a general vertical sectional view showing a variation of the first embodiment.

Alternatively, as shown in FIG. 8, the rear cylinders 14 and 14' are molded with a transparent resin, and colored printing P is placed in a circumferential portion of the window 14*a* so that the rotational drum can be made visible through the window 14*a*. Further, a transparent body configuring the window can be separately produced to be fitted inside the window 14*a*. The window 14*a* may be a through-hole, or a transparent body or a transparent resin may be provided inside the window 14*a* to prevent dust, trash, and the like from entering the writing utensil.

In the non-limiting embodiments described above, a refill is described, for example, as a writing medium. However, this embodiment is not limited whatsoever, and a lead advancing mechanism containing lead (or another substance) a writing medium may alternatively be adopted. A lead advancing mechanism includes a chuck to hold a lead and a lead tank connected to the chuck. The chuck and the lead tank may be urged rearwardly by a chuck spring. The rear position of the lead tank is regulated by the cam cylinder. The cam cylinder moves rearwardly and forwardly between a forward position and a withdrawal position. In this manner, the chuck and the lead tank move rearwardly and forwardly in an interlocking fashion, so that the invention can be applied to a mechanical pencil propelling a lead a predetermined quantity at a time.

While the invention has been described in terms of preferred embodiments, those skilled in the art will recognize that the invention can be practiced with modification within the spirit and scope of the appended claims.

What is claimed is:

1. A knocking writing utensil for use with a writing medium, comprising:

an external cylinder for receiving the writing medium, said medium being urged rearwardly;

a rotational cam mechanism comprising a cam cylinder capable of rotating and moving rearwardly and forwardly inside the external cylinder and regulating rearward movement of the writing medium, a cam body for rotating the cam cylinder at a predetermined angle every time the cam cylinder is propelled forwardly so that the cam cylinder moves alternately to a forward position and a withdrawal position, and a cam bar capable of pushing the cam cylinder forwardly; and a knock body being connected with the cam bar so that a knock operation is feasible, said knock body undergoing a knock operation so that said cam cylinder rotates as well as moves rearwardly and forwardly in the axial direction to drive the writing medium, wherein a window, from which an interior of said external cylinder is visible, is provided at a portion of a circumferential surface of the external cylinder, and wherein a rotational drum, having indications on an outer circumferential surface thereof and rotating in an interlocking fashion with rotation of said cam cylinder, is located inside the external cylinder so that said indications are visible from said window.

2. The knocking writing utensil according to claim 1, wherein said knock body is integrally formed with the cam bar.

3. The knocking writing utensil according to claim 1, wherein said indications include letters and illustrations.

4. The knocking writing utensil according to claim 1, wherein said rotational drum is connected to the cam cylinder so as to be relatively movable in the axial direction and incapable of relatively rotating relative to the cam cylinder, and is located so as to be incapable of moving in the axial direction relative to the external cylinder.

5. The knocking writing utensil according to claim 4, wherein said cam cylinder and said rotational drum are connected together by a polygonal-shaped cylinder, formed in one of said cam cylinder and said rotational drum, being fitted into a polygonal-shaped bore formed in the other one of said cam cylinder and said rotational drum.

6. The knocking writing utensil according to claim 1, further comprising a transparent body inside said window.

7. The knocking writing utensil according to claim 6, wherein said transparent body comprises a magnifying lens.

8. The knocking writing utensil according to claim 1, further comprising a transparent body inside said window so that said transparent body and at least a portion of the external cylinder are integrally molded with one of a dichroic molding technique and an insert molding technique.

9. The knocking writing utensil according to claim 1, wherein at least a portion of said external cylinder including the window is molded with a transparent resin, and color printing is applied onto at least a portion of the external cylinder surrounding said window.

10. The knocking writing utensil according to claim 1, wherein a transparent body is fitted into said window.

11. A knocking writing utensil for use with a writing medium, comprising:

an external cylinder for receiving said writing medium, said writing medium being urged rearwardly;

a rotational cam mechanism comprising a cam cylinder incapable of rotating but capable of moving rearwardly and forwardly inside the external cylinder and regulating rearward movement of the writing medium, a cam body, which is located inside the external cylinder incapable of moving rearwardly and forwardly, rotating at a predetermined angle every time the cam cylinder is propelled forwardly so that the cam cylinder moves alternately to a forward position and a withdrawal position, and a cam bar capable of pushing the cam cylinder forwardly; and a knock body being connected with the cam bar so that a knock operation is feasible, said knock body undergoing a knock operation so that the knock body rotates and the cam cylinder moves rearwardly and forwardly in an axial direction to drive the writing medium, wherein a window, from which an interior of the external cylinder is visible, is provided at a portion of a circumferential surface of the external cylinder, and wherein a rotational drum, having indications on an outer circumferential surface thereof and rotating in an interlocking fashion with rotation of said cam body, is located inside the external cylinder so that said indications are visible from said window.

12. The knocking writing utensil according to claim 11, wherein said knock body is integrally formed with the cam bar.

13. The knocking writing utensil according to claim 11, wherein said indications include letters and illustrations.

14. The knocking writing utensil according to claim 11, wherein said rotational drum is formed integrally with a cam body.

15. The knocking writing utensil according to claim 11, further comprising a transparent body inside said window.

16. The knocking writing utensil according to claim 15, wherein said transparent body comprises a magnifying lens.

17. The knocking writing utensil according to any claim 11, wherein said window includes a transparent body inside said window so that said transparent body and at least a portion of the external cylinder are integrally molded with one of a dichroic molding technique and an insert molding technique.

18. The knocking writing utensil according to claim 11, wherein at least a portion of said external cylinder including the window is molded with a transparent resin, and color printing is applied onto at least a portion of the external cylinder surrounding said window.

19. The knocking writing utensil according to claim 11, where in a transparent body is fitted into said window.

20. A knocking writing utensil for use with a writing medium, comprising:

an external cylinder having a window formed therein through which an interior of said cylinder is visible;

a rotational drum rotatably positioned in said external cylinder and carrying indicia, wherein each time said utensil is knocked, said indicia visible to a user are varied; and a rotational cam mechanism, said rotational cam mechanism comprising:

a cam cylinder capable of rotating and moving rearwardly and forwardly inside the external cylinder and regulating rearward movement of the writing medium, a cam body for rotating the cam cylinder at a predetermined angle each time the cam cylinder is propelled forwardly, said cam cylinder moving alternately to a forward position and a withdrawal position, and a cam bar for pushing the cam cylinder forwardly.

21. The knocking writing utensil, as claimed in claim 20, further comprising:

a knock body being connected with the cam bar for performing a knock operation, said cam cylinder rotating and moving rearwardly and forwardly in an axial direction to drive the writing medium.

22. The knocking writing utensil according to claim 21, wherein said knock body is integrally formed with the cam bar.

23. The knocking writing utensil as claimed in claim 22, wherein said rotational drum rotates in an interlocking fashion with a rotation of said cam cylinder, wherein indicia are provided on an outer circumferential surface of said rotational drum, and wherein said indicia are visible through said window.

24. The knocking writing utensil, as claimed in claim 22, wherein said rotational drum located inside the external cylinder rotates in an interlocking fashion with a rotation of said cam cylinder.

25. The knocking writing utensil according to claim 24, wherein said rotational drum is connected to the cam cylinder so as to be relatively movable in the axial direction and incapable of relatively rotating relative to the cam cylinder, and is located so as to be incapable of moving in the axial direction relative to the external cylinder.

26. The knocking writing utensil according to claim 25, wherein said cam cylinder and said rotational drum are connected together by a polygonal-shaped cylinder, formed in one of said cam cylinder and said rotational drum, being fitted into a polygonal-shaped bore formed in the other one of said cam cylinder and said rotational drum.

27. The knocking writing utensil, as claimed in claim 20, further comprising a writing medium located inside the external cylinder and urged rearwardly.

* * * * *